US005683732A

United States Patent [19]

Baxter et al.

[11] Patent Number: 5,683,732

[45] Date of Patent: Nov. 4, 1997

[54] CARBONATED BEVERAGE CONTAINER AND METHOD OF MANUFACTURE THEREFORE

[75] Inventors: William Ronald Stuart Baxter; Raymond Anthony Edgson, both of Cambridge; Iain Wallace Anderson, Burton-on-Trent, all of United Kingdom

[73] Assignee: Bass plc, England

[21] Appl. No.: 436,226

[22] PCT Filed: Aug. 25, 1994

[86] PCT No.: PCT/GB94/01860

§ 371 Date: Aug. 17, 1995

§ 102(e) Date: Aug. 17, 1995

[87] PCT Pub. No.: WO95/08493

PCT Pub. Date: Mar. 30, 1995

[30] Foreign Application Priority Data

| | | | |
|---|---|---|---|
| Sep. 18, 1993 | [GB] | United Kingdom | 9319362 |
| Dec. 9, 1993 | [GB] | United Kingdom | 9325228 |
| Mar. 25, 1994 | [GB] | United Kingdom | 9405945 |

[51] Int. Cl.[6] ..... B65D 85/00

[52] U.S. Cl. ..... 426/115; 426/131

[58] Field of Search ..... 222/399, 190; 426/112, 115, 118, 119, 131, 394, 395, 397

[56] References Cited

U.S. PATENT DOCUMENTS

| | | | |
|---|---|---|---|
| 4,524,078 | 6/1985 | Bardsley et al. | 426/115 |
| 4,832,968 | 5/1989 | Forage et al. | 426/115 |
| 5,584,165 | 12/1996 | Wright | 426/115 |

FOREIGN PATENT DOCUMENTS

| | | |
|---|---|---|
| 0360374 | 3/1990 | European Pat. Off. . |
| 0360375 | 3/1990 | European Pat. Off. . |
| 0448200 | 9/1991 | European Pat. Off. . |
| 2267882 | 12/1993 | United Kingdom . |
| 2273917 | 7/1994 | United Kingdom . |
| 9107326 | 5/1991 | WIPO . |
| 9310021 | 5/1993 | WIPO . |

*Primary Examiner*—Philippe Derakshani

*Attorney, Agent, or Firm*—Andrus, Sceales, Starke & Sawall

[57] ABSTRACT

A sealed, openable liquid container, e.g., for a beverage such as beer, comprises a container (10) partly filled with liquid (24) to provide a primary headspace (26). Secured to the base of the container (10) by means of adhesive (16) is an insert (14) in the form of a hollow body (18) having an upper restricted orifice (20) and a lower restricted orifice (22) therein. The hollow body (18) is partly filled with liquid derived from the main body of the container (10) so that a secondary headspace (23) is provided. The upper restricted orifice (22) communicates with the headspace (23), whilst the restricted orifice (22) is submerged in the liquid. The upper restricted orifice (22) is of a size such that the bubble point effect prevents loss of gas from the headspace (23) into the liquid (24) until a large pressure differential occurs across the orifice (20) when the container (10) is opened by means of tab (30).

22 Claims, 5 Drawing Sheets

CARBONATED BEVERAGE CONTAINER AND METHOD OF MANUFACTURE THEREFORE

This invention relates to a liquid container which is designed to deliver a liquid, for example, a high quality carbonated beverage such as beer, ale, stout or lager, so that a rich creamy foam is formed on top of the liquid by virtue of gas under pressure which is forced through at least one restricted orifice in an insert in the container so that the discharge of the gas into the main body of liquid in the container causes fine gas bubbles to enter the liquid in the container to assist in the formation of such rich creamy foam. The present invention is also applicable to other carbonated liquids and non-carbonated liquids leg soft drinks such as, for example, fruit juices, squashes, colas, lemonades, milk and milk-based drinks, and other alcoholic drinks such as, for example, spirits, liqueurs, wine or wine-based drinks) where it is desired to produce release of a stream of gas bubbles into the liquid on opening of the container. The present invention further relates to a method of manufacturing such a liquid container.

GB-A-1266351 discloses a number of designs of beverage container where a secondary chamber is located in the beverage container and contains gas charged to a pressure substantially above atmospheric pressure. A number of embodiments are described. In one embodiment, the secondary chamber is permanently in communication with the container via the restricted orifice and is charged with gas under pressure at the time of filling of the container. In another embodiment, the secondary chamber is filled with gas and the restricted orifice sealed with gelatine or other non-toxic substance which is intended to retain the gas under pressure within the secondary chamber but which dissolves when in contact with the beverage in the container so as to open the restricted orifice. In a further embodiment, the restricted orifice is provided in a flexible wall of the chamber which is exposed to the pressure in the main body of the container, the arrangement being such that pressure in the main body of the container holds the region of the wall around the restricted orifice sealed against a grommet until the container is opened, whereupon the resultant release of pressure results in the seal being broken and permits the gas under pressure from the secondary chamber to jet into the beverage through the restricted orifice. For a variety of reasons, none of these designs have met with commercial success.

EP-A-0227213 discloses a beverage container wherein, instead of gas being jetted from the secondary chamber by way of a restricted orifice, carbonated beverage or carbonated beverage followed by gas is jetted through the restricted orifice in order to induce fine bubble formation in the main body of the beverage. The secondary chamber may be in the form of a moulded plastics hollow insert which, before use, is flushed with nitrogen to displace air therefrom which would otherwise cause oxidative spoilage of the beverage. The insert (with the restricted orifice facing downwardly) is then secured in place at the bottom of the container which at this stage is open at the top. The container is partially filled with the carbonated beverage, and then dosed with liquid nitrogen and sealed so that the liquid nitrogen evaporates to pressurise the sealed container. As a result of pressure equalisation, beverage derived from the main body of the container is forced into the insert so as to leave a pressurised headspace above the beverage in the insert. The sealed and pressurised container is then pasteurised, packaged and stored before distribution and sale. Such an insert is specifically designed to discharge beverage through the restricted orifice for the stated purpose of providing a greater efficiency in the development of the head in a liquid supersaturated with gas than will ejection of gas alone through the restricted orifice. However, it is now recognised that ejection of gas through the restricted orifice does produce better results, as acknowledged in EP-A-0520646 which discloses a similar insert to that used in EP-A-0227213 but where, after filling and sealing, the container is quickly inverted so that restricted orifice lies within the headspace in the inverted container. If inversion takes place within a few seconds after filling and sealing, it is said that only a relatively small amount of beverage finds its way into the insert and such beverage is contained in a well in the insert below the restricted orifice so as to ensure that gas is ejected from the restricted orifice rather than beverage upon opening of the container. Thus, it is a problem with the system disclosed in EP-A-0227213 that it is less effective in producing the required effect upon opening of the container, whilst it is a problem with the system of EP-A-0520646 that prompt inversion of the container after filling and sealing is an absolutely essential requirement in order to ensure that gas will be ejected from the insert upon opening of the container. An additional problem with the inserts of EP-A-0227213 and EP-A-0520646 is that it is difficult to remove their enclosed air content by flushing, for example with nitrogen, before insertion into the container. WO-A-93/10021 discloses a number of different designs of device for discharging gas into a liquid such as beer in a container when the latter is opened. In most of these, a barrier embodied in a piston is provided for separating the container into a gas-containing region and a liquid-containing region. In most embodiments, the barrier is provided with a valve mechanism or a microporous membrane which allows gas to enter the liquid when the container is broached but which prevents liquid from entering the gas-containing region. During filling, the empty container is purged with nitrogen to remove air, the piston is then inserted into the container which is then charged with liquid, sealed and pasteurised. During this procedure, the increased pressure within the sealed container forces the piston along the container to pressurize the gas. Whilst such an arrangement facilitates purging with nitrogen, it is relatively expensive to produce because (a) the piston is relatively large in size and has to be accurately manufactured so that it will slide under pressure in one direction during charging but will resist sliding in the opposite direction when the container is opened, and (b) a valve mechanism or microporous membrane is required to be provided in most embodiments. In the cases where a microporous membrane is provided, it may be difficult to achieve the required rate of gas discharge into the liquid to produce effective foaming of the latter.

EP-A-0448200 discloses a design of insert or pod which operates in a similar manner to that described above in relation to EP-A-0227213 but which is magnetically retained in position in the can rather than being held by flexible retaining tabs. Thus, much the same disadvantages as noted above for EP-A-0227213 apply here also.

It is an object of the present invention to obviate or mitigate the above problems.

According to one aspect of the present invention, there is provided a sealed, openable liquid (e.g, beverage) container which is pressurised to a pressure greater than atmospheric pressure and which is partly filled with liquid so as to define a primary headspace, and a hollow body in the container, said hollow body having at least one upper restricted orifice and at least one lower restricted orifice, said upper and lower restricted orifices providing communication between the interior of the hollow body and the interior of the container, the interior of the hollow body being partly filled with liquid so that (a) said at least one upper restricted orifice opens into a secondary headspace defined within the hollow body above the liquid therein and (b) said at least one lower restricted orifice is submerged in the liquid, and said at least one upper restricted orifice being of a size such that, despite being in communication with the liquid in the container, it is effectively sealed against release of gas from the secondary headspace into the liquid in the container until the latter is opened.

Preferably, the hollow body comprises an insert, ie a part which is inserted into the container. Such insert may be an enclosed hollow body having said orifices therein. In this case, the enclosed hollow body may have a flange by means of which the insert is secured in position in the container. Alternatively, the insert may be an open-ended hollow body having said orifices therein and a flange to enable the open end to be closed by a wall of the container so that the interior of the body is in communication with the interior of the container only by way of the restricted orifices. As a further alternative, the hollow body may defined by the wall of a recess in a base wall integrally formed with the container, said recess opening onto the outside of the container and being sealed by a closure externally of the container so that the interior of the hollow body is defined between the recess in the base wall and the closure.

The terms "upper" and "lower" are used in relation to the container when in an orientation in which it is intended to be opened.

It is to be appreciated that the present invention relies on the phenomenon which will be referred to hereinafter as "the bubble point effect". The bubble point effect occurs when a bubble of gas is formed at a restricted gas/liquid interface. Surface tension forces acting around the periphery of the bubble have to be overcome before a bubble can form completely and break free into the liquid. Thus, in the present case, a certain minimum pressure difference across the upper restricted orifice is required to cause a bubble of gas to be released from the secondary headspace. In the present invention, the design is such that this minimum pressure difference is exceeded to allow release of gas from the secondary headspace into the liquid into the container only upon opening of the container. Internal pressure variations within the sealed container will inevitably occur during subsequent processing after sealing leg during pasteurisation and cooling), and as a result of pressure and temperature variations resulting from transportation and storage under varying temperature conditions. Such internal pressure variations occur at rates much lower than exist at the time of opening of the container and are accompanied by a pressure equalisation within the hollow body by a net flow of liquid in the appropriate direction through said at least one lower restricted orifice which, being totally submerged in the liquid, is not subject to the bubble point effect. Under these conditions, the minimum pressure difference across the upper restricted orifice required to overcome the bubble point effect is never attained with the result that there is no flow of gas out of said at least one upper restricted orifice.

It is to be appreciated also that there will be an insignificant discharge of liquid from the hollow body through said at least one lower restricted orifice upon opening of the container because of the much greater resistance to flow of the liquid as compared with gas. Experiments using a transparent walled pressurisable container have shown that, upon opening of the container, it is the jetting of the gas from the secondary headspace through said at least one upper restricted orifice which produces the desired release of gas and foaming of the liquid, and that there is no noticeable formation of foam in the region of said at least one lower restricted orifice.

One of the main factors affecting the magnitude of the bubble point effect is the size of the restricted orifice. Since the size of the restricted orifice also affects the rate of discharge of gas from the hollow body upon opening of the container, the size of said at least one upper restricted orifice has to be chosen to satisfy both requirements. Thus, it is possible to choose a single upper restricted orifice provided that it does not have a sufficiently large diameter for the bubble point to be insufficient to prevent undue loss of gas from the headspace in the hollow body before the container is opened. If this is a risk, then it is possible to obtain an equivalent gas flow rate by using more than one restricted orifice of the appropriate smaller size. Also, the size and number of the lower restricted orifices must also to taken into account to achieve the desired result.

During sealing of the container, pressurisation also takes place and this causes liquid to be forced into the hollow body through the restricted orifices so as to compress the gas which fills the hollow body. During the sealing and pressurizing stage, it is possible for liquid to enter the hollow body through both the upper and the lower orifices since the pressure difference which occurs at this stage is usually sufficient to overcome the bubble point. Typically for a beverage such as beer, after the container has been pressurized, the beverage will compress the gas in the hollow body so that, in the sealed container, the beverage may occupy about 60 to 75% of the inner volume of the hollow body, but nevertheless such beverage does not contribute to any observable extent in the establishment of the desired foaming of the beverage upon opening of the container.

The wetting characteristics of the surface at which the gas/liquid interface exists at said at least one upper restricted orifice also affects the magnitude of the bubble point effect. Ideally, the surface is hydrophobic rather than hydrophilic. Thus, the whole of the hollow body may be made of a suitably hydrophobic polymer, e.g., polypropylene or polyethylene, or it may be formed of a hydrophilic polymer or metal with a suitable hydrophobic region in which said at least one upper restricted orifice is formed. For example, the hollow body may be formed of a metal such as aluminium apart from a separately formed part or grommet of suitably hydrophobic material in which said at least one upper orifice is formed. Alternatively, said at least one upper restricted orifice may be formed in a metal part such as aluminium which is then coated with a suitable material, e.g, a lacquer which not only serves to impart the necessary surface properties in the region of the orifice or orifices, but also serves to protect the metal against chemical attack. The above applies also to said at least one lower restricted orifice.

The orifices may be formed by any suitable operation such as by a drilling, piercing (eg by a laser), punching or plunging operation as desired. If the hollow body is coated with a coating material such as a lacquer after formation of the orifices therein, then care should be taken to prevent the orifices from becoming obscured by the coating material or at least to allow only a relatively thin film of such coating material to form over the orifices such that the film can rupture at some stage of production so as to permit pressurization of the gas in the hollow body. Alternatively, the orifices may be formed in separate parts leg as mouldings, pressings or forgings) which are fitted to the hollow body.

Said at least one upper restricted orifice may be arranged to discharge upwardly into the body of liquid in the container. However, it may be advantageous to arrange for said at least one upper restricted orifice to discharge downwardly or sideways into the liquid. Likewise, it is not necessary for said at least one lower restricted orifice to discharge downwardly, it/they may be arranged to discharge upwardly or sideways into the beverage in the container. Thus, it is not necessary for the upper and lower restricted orifices to be located in the upper and lower faces of the hollow body.

Said at least one upper restricted orifice is preferably of circular cross-section, in which case the diameter thereof may be in the range of 0.2to 1.0mm, a preferred diameter range being 0.25 to 0.4 mm. As far as said at least one lower restricted orifice is concerned, the same considerations may apply. In the case of a circular lower restricted orifice, the diameter thereof can be in the same range of 0.2 to 1.0 mm, preferably 0.25 to 0.4 min. The size of the lower restricted orifice depends not only upon the number thereof but also upon the chosen size and number of the upper restricted orifice or orifices.

Depending upon the manner in which the liquid container is processed, handled and stored after it has been sealed under pressure, it may be necessary for said at least one lower restricted orifice also to be of a size to support the bubble point effect to about the same extent as said at least one upper restricted orifice. For example in the case of a liquid requiring pasteurisation, if the container is inverted for pasteurisation and subsequent cooling in such a manner that the upper and the lower restricted orifices are submerged in the liquid in the container, then said at least lower restricted orifice (which is exposed to the secondary headspace in the hollow body when the container is inverted) will need to exhibit the required bubble point effect to prevent loss of gas from the hollow body upon cooling following pasteurisation.

The above variables can be selected by relatively simple trial and experiment having regard to the particular circumstances such as the type of beverage, the size of container, the internal pressure and the nature of the surface surrounding the restricted orifices.

The hollow body itself may be formed by blow moulding in a single piece or formed in two or more parts which may be connected together by a snap-fit, weld, crimp, bayonet-fit, interference-fit or screw-fit connection. For example, the parts may be moulded out of a suitable polymer in the same moulding operation with an integral hinge and with respective formations thereon to enable the parts to be snapped together to form the hollow body. If desired, an appropriate formation or formations (eg a channel or channels) may be provided on one or both of said parts which, when the latter are connected together, define at least some of the orifices. In the case where a flange is provided, this may be integrally formed with one of the parts of the hollow body. Since the hollow body is not required to be hermetically sealed, there is no need for there to be a complete seal between these two parts, just so long as the fit between such parts does not leak to such an extent that the desired bubble point effect is lost and the desired gas release upon opening of the container is not adversely affected.

However, in a currently preferred embodiment, a base wall of the container is used to define part of the hollow body so that the item inserted into the container comprises a hollow body having an open end surrounded by a flange which is preferably shaped to conform substantially to a portion of the base wall of the container with which it is engaged and which is retained in the container with the flange in sealing engagement with said portion of the base wall, the hollow body having said at least one upper restricted orifice and said at least one lower restricted orifice therein.

Preferably, the hollow body is retained in the container by a layer of adhesive which is disposed between the flange and the base wall and which may also serve to seal the joint between the flange and the base wall. In the case where the hollow body is a closed hollow body, the adhesive does not have to withstand the pressure force upon opening, and so a comparatively inexpensive adhesive, such as a hot melt adhesive or pressure sensitive adhesive, which does not need high temperature curing, can be employed. This in turn permits the insert to be formed from a relatively inexpensive plastics material which does not need to be particularly resistant to high temperatures.

Preferably, said at least one upper restricted orifice is provided in or adjacent an end of the hollow body remote from the open end.

Preferably, said at least one lower restricted orifice is provided in the hollow body adjacent said flange.

The hollow body and the container may be formed of the same or dissimilar materials, eg aluminium, steel, plastics etc.

In the case where the hollow body is defined by the wall of an outwardly opening recess in the base wall integrally formed with the container, the container together with base wall and recess may be formed of PET (polyethyleneterephthalate) or PEN (polyethylenenaphthalate) by a blow moulding operation, followed by formation of said restricted orifices in the wall of the recess leg by piercing the wail with retractable hot pins), and then closing the hollow body by sealing a disk leg by ultrasonic welding) across the opening of the recess. Where the container is formed of PEN, the container after filling and sealing can be subjected to the usual pasteurisation procedure since PEN is sufficiently heat-resistant to withstand pasteurisation temperatures. However, when the container is formed of PET, it will normally be necessary to fill the container with beverage and effect sealing under sterile conditions so as to avoid the need for subsequent heat pasteurisation.

We have also found that it is preferred for said at least one upper restricted orifice to be defined by a passage having a length which is greater than the width of the orifice. This is because such an arrangement is more resistant to gas loss from the insert when the container is subjected to rough handling. Accordingly, in the case where the part of the hollow body defining such orifice is formed of a thin walled material leg metal), it is preferred for such passage to be defined either by a separately formed element which is engaged in an aperture in said hollow body part or, more preferably, by a suitably shaped part of the material itself, eg by a deep drawing or impact extrusion operation. In the case where the hollow body is formed of plastics material, the passage may be moulded with the body.

Preferably, said at least one upper restricted orifice is defined at one end of a tapered passage whose other end opens into the interior of the hollow body. Preferably, the tapered passage has a length of at least 1.5 mm and the included angle of taper is preferably about 5 to 20° and is more preferably about 5 to 12° . Preferably, for an upper restricted orifice having a diameter of about 0.25 mm, the opposite end of the tapered passage which opens into the interior of the hollow body has a diameter of about 1.2 mm.

It is particularly convenient for the tapered passage to be provided in a plastics hollow body which may be formed of polypropylene or of a more temperature resistant plastics material, eg Nylon, if a heat curable resin such as an epoxy resin is used for securing the hollow body (or part thereof) to the base wall of the container.

Preferably, said at least one lower restricted orifice is defined at one end of a tapered passage whose opposite end opens into the interior of the hollow body, with the taper decreasing towards said lower restricted orifice. The tapered passage preferably has a length of at least 1.5mm. The included angle of taper is preferably about 5 to 20° , and is more preferably about 5 to 12°.

The tapered passage may be frusto-conically tapered or it may include a "trumpet" shape or flare, i.e., one in which the end of the passage opening into to the hollow body has a curved flare thereto.

The tapered passage defining said at least one upper restricted orifice and/or said at least one lower restricted orifice is preferably formed by a nozzle which is disposed within a localised recess in the hollow body to minimise the risk of damage to the nozzle during handling before introduction of the hollow body (or part thereof) into the container.

In order to secure the hollow body (or part thereof) to the base wall of the container, instead of using a hot melt adhesive or a pressure sensitive adhesive, it may be preferred to use an epoxy resin leg a 1-part epoxy resin).

In the case where the hollow body is formed of aluminium, it is convenient to perform a lacquering operation thereon in order to prevent direct contact between the beverage and the aluminium. Alternatively, stainless steel may be employed for providing an inert surface which is destined to be in contact with the beverage in use. As further alternatives, tinned steel or lacquered steel may be employed.

The upper and lower restricted orifices may be arranged so that, when the container is inverted for pasteurisation, either (a) only said at least one lower restricted orifice is exposed in the headspace or (b) the upper and the lower restricted orifices are disposed in the headspace within the inverted container. Because the hollow body used in all embodiments has upper and lower restricted orifices, it will be appreciated that it is relatively easy for liquid to enter the hollow body upon sealing and pressurisation. In fact, it can take as little as about 4 seconds for substantial amounts of liquid to enter the hollow body following sealing. In other words, pressure equalisation between the main body of the container and the hollow body occurs very rapidly under such circumstances. If it is impracticable to invert the container sufficiently rapidly after sealing to prevent substantial quantities of liquid entering the hollow body, then it may be possible for drainage of liquid from the hollow body to take place provided that the level of liquid inside the hollow body is higher than the level of liquid in the main body of the container. In this regard, it is preferred to arrange for the upper restricted orifice in the inverted container to be submerged to the minimum possible depth below the surface of the liquid in the main body of the container in order to promote maximum drainage of liquid from the hollow body. This enables the size of the hollow body to be minimised for a given volume of gas which will be retained within the hollow body. Whilst theoretically the most complete drainage can occur when no part of the hollow body is immersed in the liquid in the main body of the inverted can, in practice there is a risk that the bubble point effect at the upper restricted orifice will impede proper drainage of liquid from the hollow body under these conditions.

When hollow bodies are being transported on a conveyor in side-by-side relationship prior to insertion into the container, there may be a tendency for the flange of one hollow body to ride up on top of the flange of an adjacent hollow body. This can create handling difficulties. In order to overcome this disadvantage, it is preferred for the flange not to project outwardly beyond the periphery of the main portion of the hollow body to an extent sufficient for the flange to ride up over the flange of an adjacent hollow body.

In a preferred embodiment, the flange projects no further outwardly than the outer periphery of the hollow body. This can conveniently be achieved by providing the hollow body with a neck region from which the flange extends outwardly. Said at least one lower restricted orifice is preferably formed in the neck region so as to be as close as possible to the base wall of the container.

It is further to be appreciated that, since the hollow body used in the present invention has upper and lower orifices therein, it is much easier to flush with nitrogen or other inert gas to remove air therefrom than an hollow body which only has a single restricted orifice therein since it is possible to flush merely by blowing the inert gas through the upper orifice so as to displace the air through the lower orifice, or vice versa. Additionally, with the hollow body as used in the present invention, there is no need to invert the liquid container for pasteurization so as to ensure that the restricted orifice remains in the headspace, as in EP-A-0520646, although of course it is possible to invert the container for pasteurization if desired for other reasons.

According to a second aspect of the present invention, there is provided a method of manufacturing a sealed, openable liquid container according to said first aspect of the present invention, said method comprising the steps of: providing in a container a gas-filled hollow body having at least one upper restricted orifice and at least one lower restricted orifice so that said upper and lower restricted orifices provide communication between the interior and the exterior of the hollow body; partly filling the container with liquid so as to leave a primary headspace in the container; and sealing and pressurizing the container.

Preferably, the hollow body has an open end and a flange surrounding the open end, and is provided in the container by securing the body to the container so that the flange of said hollow body is in sealing engagement with a base wall of said container.

Preferably, the hollow body is secured within the container using an adhesive which is disposed between the flange of the hollow body and the base wall of the container.

Preferably also, before the container is partly filled with liquid, the hollow body is flushed with a non-oxidising gas, e.g. nitrogen, by passing said gas into the hollow body through said at least one upper restricted orifice so that air within the hollow body is flushed out through said at least one lower restricted orifice.

Embodiments of the present invention will now be described, by way of example, with reference to the accompanying drawings, in which.

Figure 1:
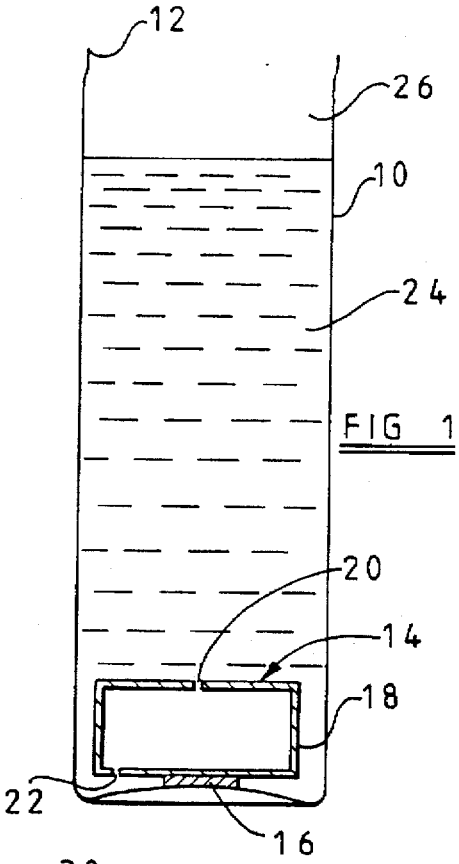
FIG. 1 is a schematic side elevation showing a liquid container according to the present invention as applied to a beverage, the container being illustrated in a condition in which it has been partly filled with beverage but before seaming a top thereon and pressurising.

Referring now to FIG. 1 of the drawings, the beverage container 10 is shown in a partly completed condition with an open top 12. An insert 14 defined by an enclosed hollow body 18 is secured to a base wall of the container 10 by a layer 16 of an adhesive such as a hot melt adhesive, although a mechanical fastening (not shown) such as a ring or legs which is/are braced against or an interference fit with the wall of the container 10 may alternatively be used. The hollow body 18, in this embodiment, is formed of any suitable food grade plastics material or of a suitably lacquered aluminium or aluminium alloy or of steel. The hollow body 18 has a single upwardly directly upper restricted orifice 20 of circular cross-section and a single downwardly directed lower restricted orifice 22 of circular cross-section in its upper and lower faces respectively, providing communication between the interior of the hollow body 18 and the interior of the container 10. In this embodiment, the diameters of the orifices 20 and 22 are the same (0.4mm), although this is not essential.

Figure 2:
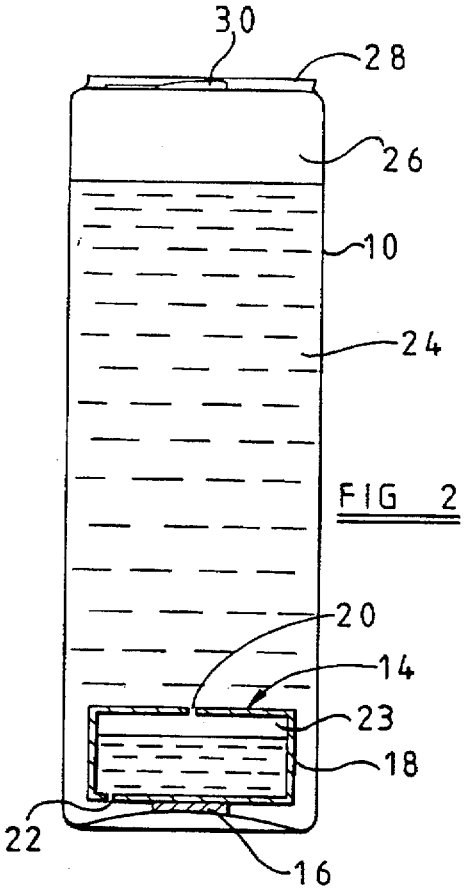
FIG. 2 is an axial section showing the beverage container after sealing, pressurisation and pasteurisation.

The container 10 is partly filled with carbonated beverage 24 (e.g, beer, ale, lager or stout) at about 0 deg C so as to leave a primary headspace 26. In this condition, the upper and lower restricted orifices 20 and 22 are submerged in the beverage 24 in the container 10. At this stage, some beverage may enter the insert 14. The headspace 26 is then dosed with a small quantity of liquid nitrogen sufficient to flush air from the headspace 26 and to provide the necessary pressurisation of the beverage container 10 after it has been sealed by seaming a top 28 thereto in a manner which is very well known in the art. Upon pressurization of the container, beverage under pressure is forced through at least the restricted orifice 22 and through the restricted orifice 20 into the interior of the insert 14. This causes the gas in the insert to be compressed to the condition illustrated on FIG. 2 until pressure equalisation occurs. In this state, there is a secondary headspace 23 in the insert above the level of beverage therein. The upper restricted orifice 20 opens into this secondary headspace 23, whilst the lower restricted orifice 22 is completely submerged in the beverage. It will be appreciated, however, that in accordance with normal canning procedure, the beverage container after seaming is subjected to pasteurisation (usually in an inverted condition) before being cooled and subsequently packaged before distribution and sale. When inverted, the arrangement is such that the insert 14 is disposed with the upper restricted orifice 20 just below the surface of the liquid 24 in the container 10 so that the minimum amount of beverage can enter the insert 14. During pasteurisation, the pressure within the container increases substantially (but relatively slowly) as a result of the elevated temperature of pasteurisation, but is force cooled or allowed to cool subsequently back to ambient temperature.

Figure 3:
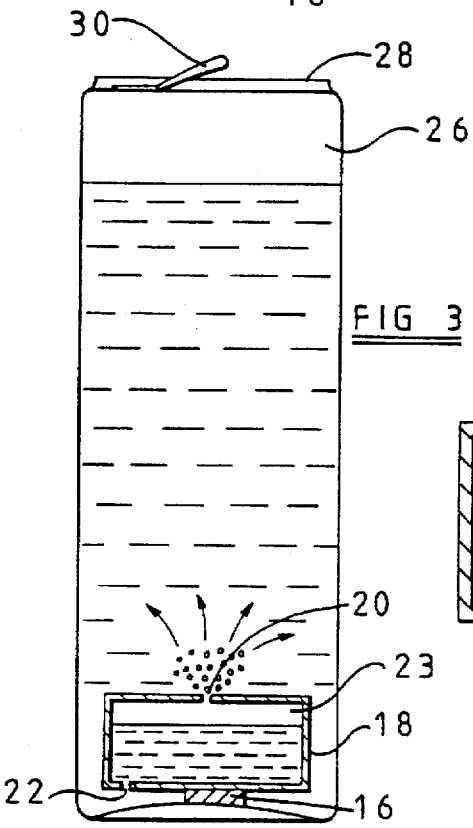
FIG. 3 is an axial section showing the beverage container immediately upon opening thereof.

When the container 10 is opened (see FIG. 3), for example, by operation of release tab 30 on the top 28, the pressure within the container 10 is immediately released thereby causing a substantial pressure difference to occur across the upper restricted orifice 20. This pressure difference exceeds the bubble point and results in gas jetting from the secondary headspace 23 in the insert 14 through the upper restricted orifice 20 to promote the formation of a swirl of bubbles upon dispensing of the beverage into a glass and the formation of a rich creamy head thereon. Because the resistance to flow of beverage is much greater than that of gas, there is scarcely any flow of beverage out of the insert 14 through the lower restricted orifice 22.

With the above-described insert, it is relatively easy to flush the insert 14 with nitrogen or any other suitable inert or non-oxidising gas to displace the air therefrom before the insert 14 is used because of the provision of the orifices 20 and 22. The flushing gas can be introduced through one of the orifices, for example the upper restricted orifice 20, so as to displace the air from the insert which is expelled through the other restricted orifice. This is a much easier operation to effect than to flush the air out of an insert having only a single restricted orifice therein.

Figure 4:
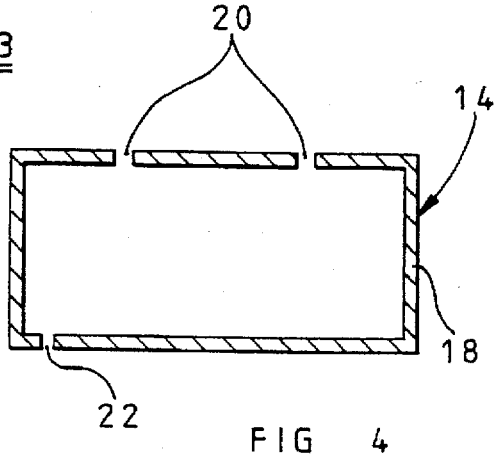
FIGS. 4 and 5 are axial sections through alternative embodiments.

In the alternative embodiment illustrated in FIG. 4, the body 18 of the insert 14 is formed with a plurality of upper restricted orifices 20 and a single lower restricted orifice 22. This enables the bubble effect to be retained with a greater potential gas flow rate through the orifices 20 upon opening of the container 10. Typically, the diameter of both of the orifices 20 and 22 is 0.4min.

Figure 5:
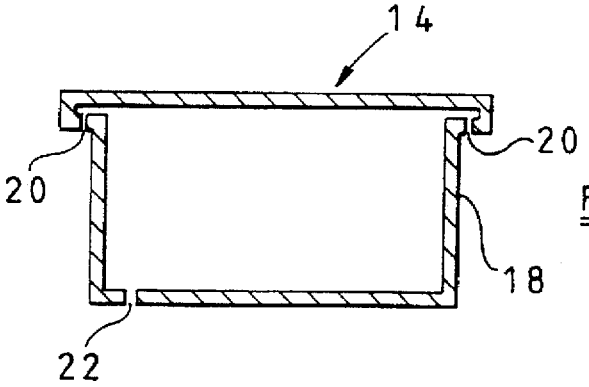

In the embodiment of FIG. 5, a plurality of upper restricted orifices 20 are provided which are arranged to eject gas downwardly into the beverage upon opening of the container.

In all of the above described embodiments of insert, the insert may be formed of two parts which can be connected together e.g, by snap-fitting, without there to be any need for a hermetic seal between such parts.

Figure 6:
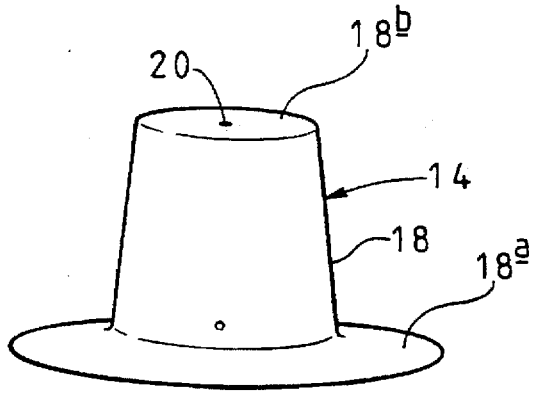
FIG. 6 is a schematic perspective view of a hollow body forming part of an insert used in a container according to another embodiment of the present invention.
Figure 7:
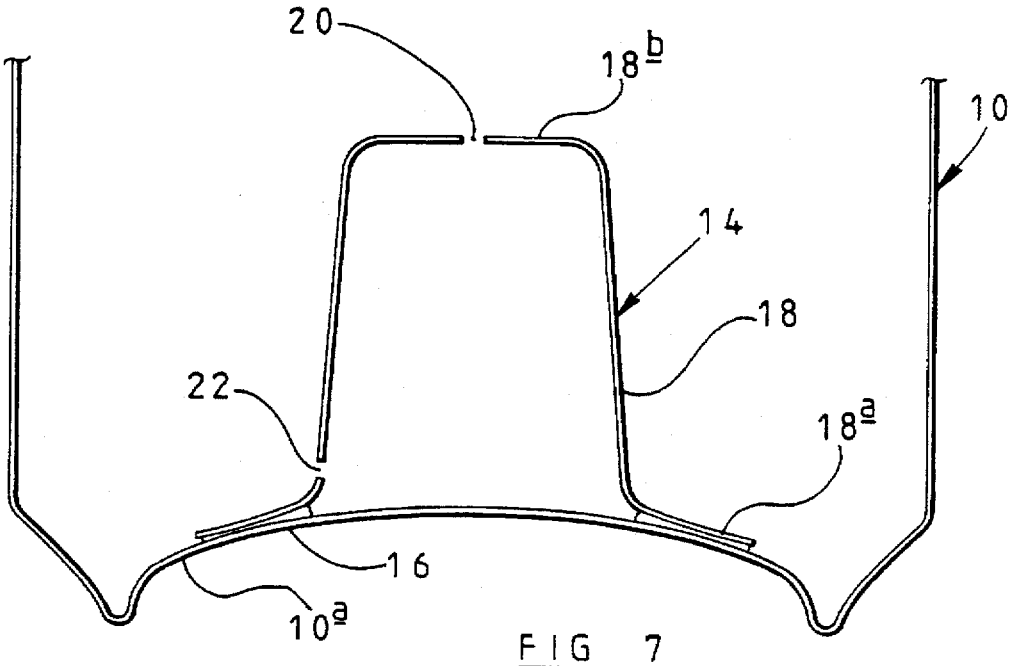
FIG. 7 is a schematic cross-sectional view of the bottom part of a container incorporating the insert of FIG. 6.
Figure 8:
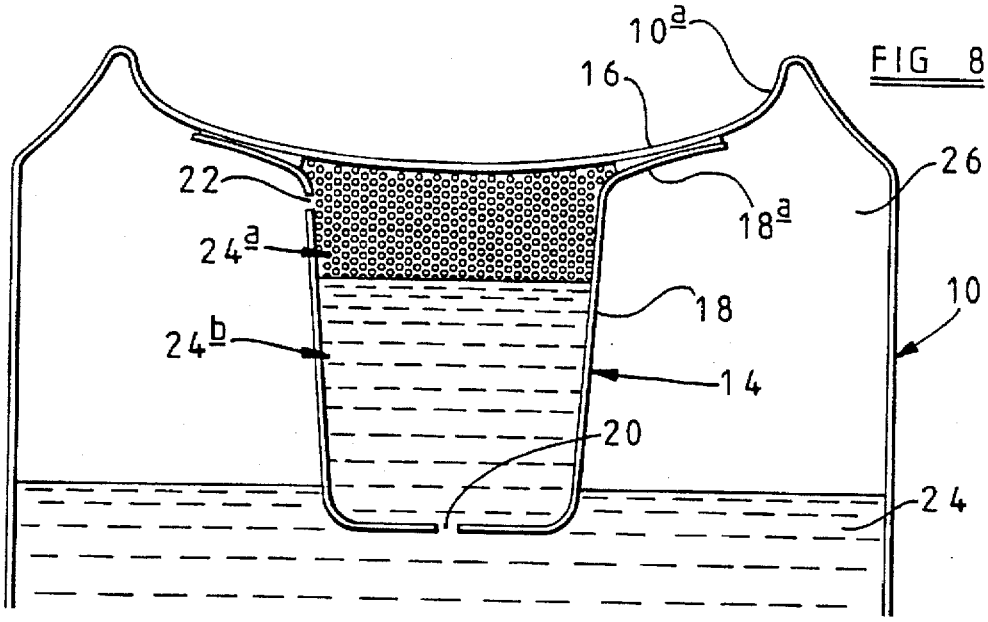
FIG. 8 is a view of the container of FIG. 7 during pasteurization.

Referring now to FIGS. 6 to 8 of the drawings, only the region of the container adjacent the bottom thereof is shown, the remainder of the container being as described above. In this embodiment, insert 14 is defined by hollow body 18 which has an open lower end surrounded by an annular flange **18*a* which is of such a frusto-conical shape that it conforms to the inwardly convex curvature of base wall 10*a* of container 10, The hollow body 18 tapers frusto-conically inwardly away from flange 18*a* towards a top surface 18*b* having upper restricted orifice 20 therein. Lower restricted orifice 22 is provided towards the lower end of body 18 just above flange 18*a***.

The hollow body 14, like the container 10, is formed of aluminium which has been lacquered after the orifices 20 and 22 have been formed therein so that all surfaces of the can 10 and insert 14 are lacquered including the walls of the orifices 20 and 22. Alternatively, tinned steel may be used instead of aluminium. The hollow body 18 is secured within the container 10 by means of a layer of hot-melt adhesive 16 which is provided as a ring around the flange **18*a* and which also serves to seal the joint between the flange 18a and the base wall 10*a***.

The hollow body 18 may be assembled into the container 10 by providing a ring of the hot-melt adhesive 16 around the flange **18*a*** and allowing it to cool. Then, the bottom wall 10*a* of the container 10 is heated and the hollow body 18 with hot-melt adhesive 16 thereon is inserted into the container 10 (which has an open top at this stage) and pressed against the heated bottom wall 10*a* to activate the hot-melt adhesive. The assembly is then allowed to cool to secure the hollow body 18 to the base wall 10*a*. Alternatively, a pressure-sensitive adhesive 16 or a two-part reactive adhesive, eg a silicone-based adhesive, may be employed. At this stage, the container 10 with insert 14 defined therein can be inspected for faulty adhesion using a vision system to ensure that there is a line of adhesive 16 extending completely around the periphery of the flange 18*a* and also to ensure that there are no unwanted blobs or extrusions of adhesive. The inspected containers 10 can then be transported to a filling line to be filled with beer or other beverage. Just before the containers 10 enter the filler, the inserts 14 are purged with an inert gas such as nitrogen so as to dilute the proportion of oxygen within the inserts 14 to the required extent (typically about 1% by volume oxygen). Following this, the containers 10 are filled with beverage, sealed and pressurized using liquid nitrogen and then pasteurized in an inverted condition as described above.

During pressurization using liquid nitrogen, rapid boiling-off of the latter results in a sharp pressure rise causing beverage to be forced through the orifices 20 and 22. This may result in the production of a head of foam 24*a* above beverage 24*b* within the insert 14. When the container 10 is inverted for pasteurization, initially the insert 14 contains foam 24*a* and beer 24*b* as illustrated in FIG. 8. A film of liquid beverage from the foam 24*a* may form over the orifice 22 to prevent the level of beverage 24*b* within the insert 14 from dropping to the level of beverage 24 within the main body of the can. Upon heating of the container 10 during pasteurization, the resultant pressure increase within the can 18 may promote breakage of any liquid film which has formed across the orifice 22 and allow the level of beverage 24*b* within the insert 14 to fall to the level of beverage 24 within the main body of the container 10. Thus, during pasteurization, the insert 14 is charged with gas under pressure from headspace 26 in the inverted container 10.

Following pasteurization, the containers 10 are cooled to ambient temperature whilst still in the inverted condition.

The insert 14 operates in the same manner as the inserts described above in relation to FIGS. 1 to 5 during storage, transportation and eventual opening of the container.

Figure 9:
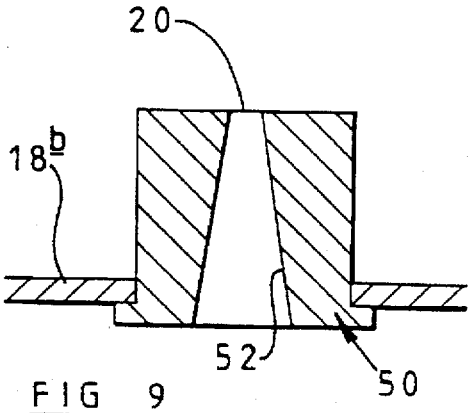
FIG. 9 is a scrap section showing a first modification of the insert of FIG. 6.

In FIG. 9, the insert of FIGS. 6 to 8 is shown with a separately formed element 50, eg of polypropylene, which is push fined into an aperture in the end 18*b* and which has a passage 52 therethrough. In this embodiment, the passage 52 tapers frusto-conically upwardly to define the orifice 20 at its upper end. The length of the passage 52 is greatly in excess of the diameter of the orifice 20. In this embodiment, the length to diameter ratio is about 7:1.

Figure 10:
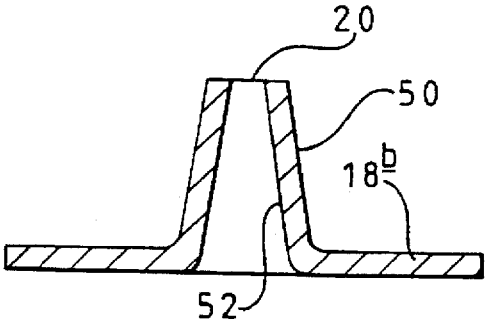
FIG. 10 is a scrap section showing a second modification of the insert of FIG. 6.

In FIG. 10, the passage 52 is defined by a deep drawing or impact extrusion operation on the material used to form the hollow body 18 so as to produce frusto-conically tapered portion 50. The use of such an elongated passage 52 permits the bubble point effect to be maintained more effectively in the event of careless or rough handling of the container.

Figure 11:
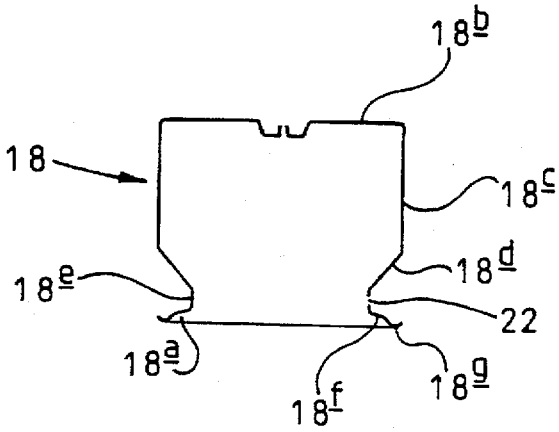
FIG. 11 is a schematic view of another form of hollow body.
Figure 12:
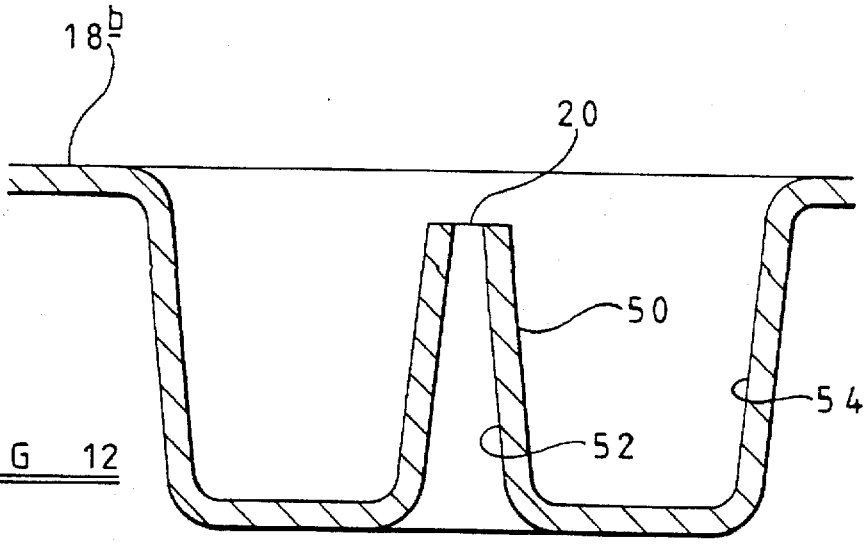
FIG. 12 is a sectional view of a detail of the hollow body of FIG. 11 showing an upper restricted orifice.
Figure 13:
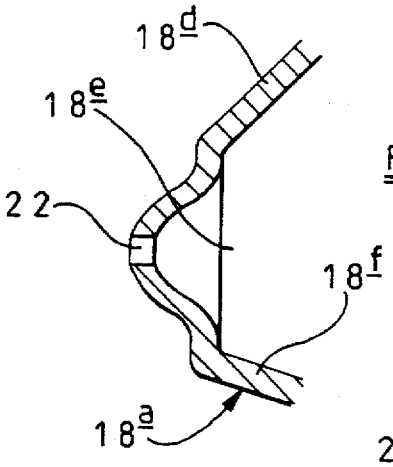
FIG. 13 is a sectional view of a detail of the hollow body of FIG. 11 showing a lower restricted orifice.

Referring now to FIGS. 11 to 13 of the drawings, parts which are similar to those of the insert of FIGS. 6 to 8 are accorded the same reference numerals. Hollow body 18 is manufactured by a pressing operation effected in the axial direction of the body 18. In this embodiment, hollow body 18 has a plain (i.e., untapered) cylindrical region 18*c* which extends for the majority of the length of the body 18 from top surface 18*b*. At its end remote from top surface 18*b*, cylindrical region 18*c* merges with a shoulder region 18*d* which tapers frustoconically downwardly and inwardly to a neck region 18*e* from which annular flange 18*a* extends outwardly. The outer diameter of flange 18*a* is marginally less than the diameter of cylindrical region 18*c* so that, when a line of side-by-side hollow bodies 18 are being conveyed and handled prior to insertion into the container, there is no risk that the flange 18*a* of one hollow body 18 will ride up over the corresponding flange of an adjacent hollow body.

In this embodiment, the flange 18*a* includes an inner flange portion 18*f* which is flared outwardly away from neck region 18*e* at an angle, in this embodiment, of about 16° to the horizontal so as to accommodate for the curvature of the base wall 10*a* of the container (see FIG. 7). The flange 18*a* also includes curved outer lip portion 18*g* which abuts against the base wall of the container and prevents all of the adhesive from being squeezed out if the body 18 is pressed against the base wall of the container too firmly. The lip portion 18*g* maintains a fixed gap between the inner flange portion 18*f* and the base wall of the container, into which gap the adhesive can spread.

The top surface 18*b* is formed with a central recess 54 from whose base extends frusto-conically tapered portion 50 with upper restricted orifice 20. The portion 50 is located wholly within the recess so that the orifice is positioned just below the plane of the upper surface 18*b*. In this way, the portion 50 and orifice 20 are protected against inadvertent damage before and during insertion into the container.

In this embodiment, lower restricted orifice 22 is provided in neck region 18*e* which has a diameter nearly 30% less than the diameter of cylindrical region 18*c*. The axial length of hollow body 18 in this embodiment is such that the top surface 18*b* with upper restricted orifice 20 lies just under the surface of the beverage in the inverted can (see FIG. 8). This permits beverage which has entered the insert before inversion to drain almost completely out of the insert 14 so as to maximise the volume of gas which is captured within the insert when the container is in the inverted condition. This has the advantage that no special measures are required to invert the container after sealing by seaming and before pressure equalisation has occurred. This is of particular advantage with inserts according to the present invention having upper and lower restricted orifices therein because pressure equalisation between the insert and the main body of the container occurs extremely rapidly after sealing and typically within one to two seconds. However, full pressure equalization may be delayed for about 7 to 12 seconds because the can pressure itself continues to rise for 5 to 10 seconds after sealing as a result of continued evaporation of liquid nitrogen.

Figure 14:
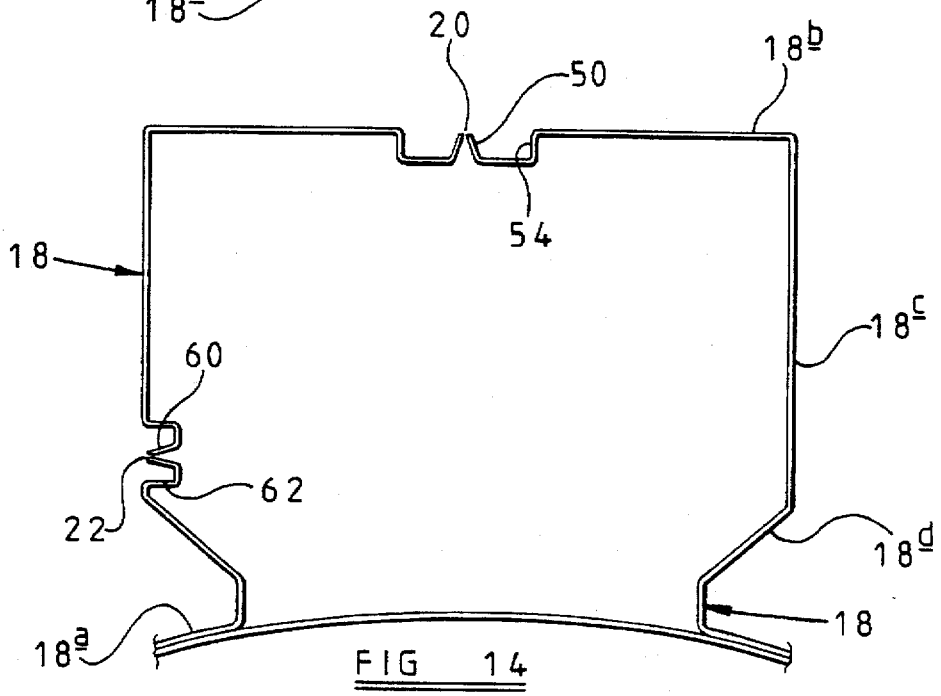
FIG. 14 is a schematic view similar to FIG. 11 of an alternative embodiment.

Preferably, the frusto-conical portion 50 has a length of about 3 mm and tapers smoothly from a maximum diameter of about 1 mm at the level of the base of the recess 54 to a minimum diameter of about 0.3 mm (the diameter of the upper restricted orifice 20), whilst the recess 54 has a total depth which is about 0.5 mm greater than the length of the portion 50. Preferably also the lower restricted orifice 22 has a diameter which is approximately the same as that of the orifice Referring now to FIG. 14, the hollow body 18 has the lower restricted orifice 22 formed in the same way as the upper restricted orifice 20 illustrated in FIGS. 11 and 12. However, unlike the orifice 22 of FIG. 13, the orifice 22 of FIG. 14 is provided in cylindrical region 18*c* rather than in neck region 18*e*. The lower restricted orifice 22 is formed at the outer end of a portion 60 having a trumpet-like taper with a length of at least 1.5 mm. In this embodiment, the orifice 22 has a diameter of 0.3 mm. The provision of such a shape of portion 60 serves to assist in breaking any liquid film which may form across the orifice 22 at a stage when the container is inverted for pasteurisation so that the orifice 22 and portion 60 lie within the headspace in the inverted container. At this stage, the hydrostatic pressure of the excess liquid level within the insert 18 tends to draw the film of liquid inwardly from the orifice 22 thereby causing it to become more and more stretched until it bursts and allows drainage to occur readily through the orifice 20.

As will be appreciated from FIG. 14, the portion 60 is disposed in a localised recess 62 in the cylindrical region 18*c* so that it is protected as far as possible against accidental damage.

In further modifications (not shown), one or both of the portions 50 and 60 is/are formed in a suitable plastics moulding which is push-fitted into an aperture in the metal insert.

Figure 15:
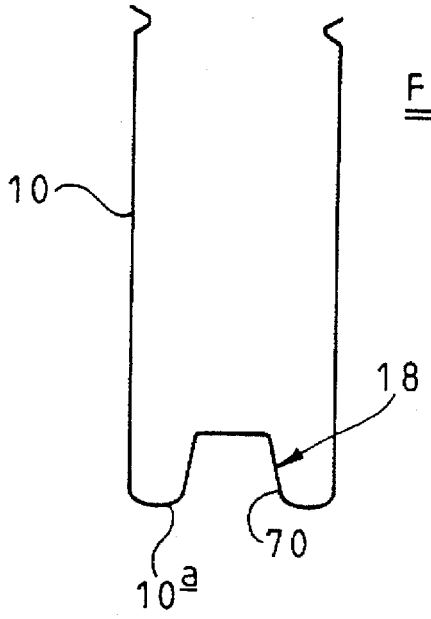
FIGS. 15 to 17 are schematic views showing the formation of a hollow body from an outwardly opening recess in a base wall of a blow-moulded container.
Figure 16:
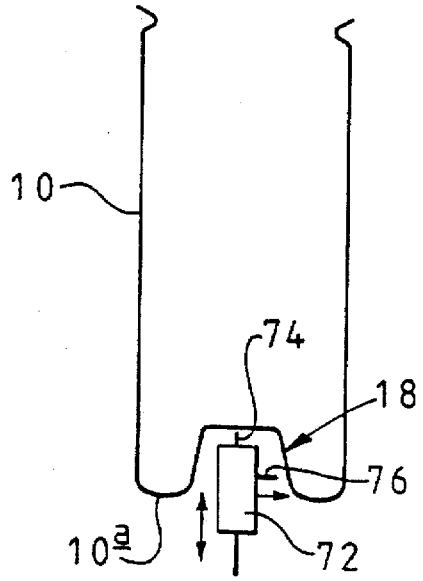
Figure 17:
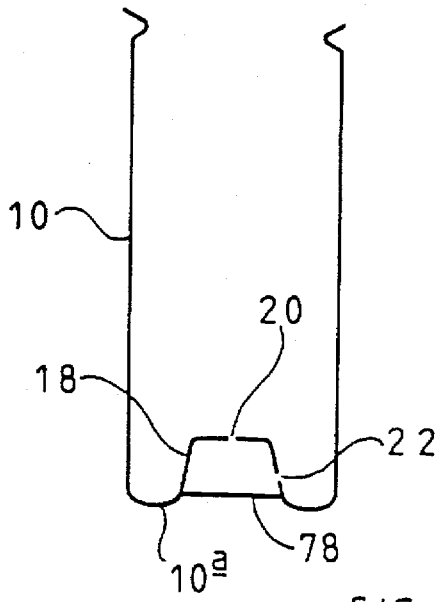

Referring now to FIGS. 15 to 17 of the drawings, there is shown schematically a method of forming the hollow body 18 integrally with base wall 10*a* of container 10. In this method, FIG. 15 shows container 10 including base wall 10*a* with outwardly opening recess 70 conveniently formed of PET or PEN by a blow-moulding operation. This may be effected on a carousel-type mechanism so that the resultant moulding can be indexed to a piercing station at which a tool 72 (FIG. 16) with hot pins 74 and 76 is introduced into the recess 70 from below and actuated so as to cause the pins 74 and 76 to puncture the wall of the recess at the required locations whereby to form the restricted orifices 20 and 22, respectively. Subsequently, the pierced container 10 is indexed to an ultrasonic welding station at which the open end of the recess 70 is closed by means of a disk 78 so that the hollow body 18 is closed and sealed.

We claim:

1. A sealed, openable liquid container which is pressurised to a pressure greater than atmospheric pressure and which is partly filled with liquid (24) so as to define a primary headspace (26), and a hollow body (18) in the container (10), said hollow body (18) having at least one upper restricted orifice (20) and at least one lower restricted orifice (22), said upper and lower restricted orifices (20 and 22) providing communication between the interior of the hollow body (18) and the interior of the container (10), the interior of the hollow body (18) being partly filled with liquid so that (a) said at least one upper restricted orifice (20) opens into a secondary headspace (23) defined within the hollow body (18) above the liquid therein and (b) said at least one lower restricted orifice (22) is submerged in the liquid, and said at least one upper restricted orifice (20) being of a size such that, despite being in communication with the liquid in the container, it is effectively sealed against release of gas from the secondary headspace (23) into the liquid (24) in the container (10) until the latter is opened.

2. A container as claimed in claim 1, wherein the hollow body (18) consists of an insert (14) which is an enclosed hollow body.

3. A container as claimed in claim 2, wherein the enclosed hollow body (18) has a flange (18*a*) by means of which it is secured in position within the container (10).

4. A container as claimed in claim 1, wherein the hollow body (18) comprises an insert (14) which is open-ended and has a flange (18*a*) to enable the open end to be closed by a wall (10*a*) of the container (10) so that the interior of the body (8) is in communication with the interior of the container only by way of the restricted orifices (20 and 22).

5. A container as claimed in claim 4, wherein the wall (10*a*) is a base wall of the container (10), and the flange (18*a*) conforms substantially to a portion of the base wall (10*a*) of the container (10) with which it is engaged and which is retained in the container (10) with the flange (18*a*) in engagement with said portion of the base wall (10*a*).

6. A container as claimed in claim 4, wherein the hollow body (18) is retained in the container (10) by a layer of adhesive (16) which is disposed between the flange (18*a*) and the wall (10*a*) and which also serves to seal the joint between the flange (18*a*) and the wall (10*a*).

7. A container as claimed in claim 1, wherein said at least one upper restricted orifice (20) is provided in or adjacent an upper end of the hollow body (18).

8. A container as claimed in claims 4, wherein said at least one lower restricted orifice (22) is provided in the hollow body (18) adjacent said flange (18*a*).

9. A container as claimed in claim 1, wherein said upper restricted orifice (20) is defined by a passage (52) having a length which is greater than the width of the orifice (20).

10. A container as claimed in claim 9, wherein the passage (52) is tapered, and said upper restricted orifice is defined at one end of the tapered passage (52) whose other end opens into the interior of the hollow body (18).

11. A container as claimed in claim 10, wherein the tapered passage has a length of at least 1.5 mm.

12. A container as claimed in claim 10, wherein the passage (52) has an included angle of taper of about 5° to 20°.

13. A container as claimed in claim 10, wherein said at least one lower restricted orifice (22) is defined at one end of a tapered passage (60) whose opposite end opens into the interior of the hollow body, with the taper decreasing towards said lower restricted orifice (22).

14. A container as claimed in claim 10, wherein the tapered passage (52 or 60) is formed by a nozzle which is disposed within a localised recess in the hollow body (18).

15. A container as claimed in claim 4, wherein the flange (18*a*) projects no further outwardly than the outer periphery of the hollow body (18).

16. A container as claimed in claim 15, wherein the hollow body (18) has a neck region (18*e*) from which the flange (18*a*) extends outwardly.

17. A container as claimed in claim 1, wherein the hollow body (18) is defined by an outwardly facing recess (70) in a base wall (10*a*) of the container (10), and by a closure member (78) closing said outwardly facing recess (70).

18. A method of manufacturing a sealed, openable liquid container as claimed in claim 1, said method comprising the steps of:

providing in a container (10) a gas-filled hollow body (18) having at least one upper restricted orifice (20) and at least one lower restricted orifice (22) so that said upper and lower restricted orifices (20 and 22) provide communication between the interior and the exterior of the hollow body (18);

partly filling the container (10) with liquid (24) so as to leave a primary headspace (26) in the container (10); and sealing and pressurizing the container (10).

19. A method as claimed in claim 18, wherein the hollow body (18) has a flange (18*a*), and is provided in the container (10) by securing the hollow body (18) to the container (10) so that the flange (18*a*) is in engagement with a base wall (10*a*) of said container (10).

20. A method as claimed in claim 18, wherein the hollow body (18) has an open end and a flange (18*a*) surrounding the open end, and is provided in the container (10) by securing the hollow body (18) to the container (10) so that the flange (18*a*) is in sealing engagement with a base wall (10*a*) of said container (10).

21. A method as claimed in claim 19, wherein the hollow body (18) is secured within the container using an adhesive (16) which is disposed between the flange (18*a*) and the base wall (10*a*) of the container (10).

22. A method as claimed in any one of claim 18, wherein before the container (10) is partly filled with liquid (24), the hollow body (18) is flushed with a non-oxidising gas by passing said gas into the hollow body (18) through said at least one upper restricted orifice (20) so that air within the hollow body (18) is flushed out through said at least one lower restricted orifice (22).

* * * * *